United States Patent [19]

Gardner et al.

[11] 3,939,013

[45] Feb. 17, 1976

[54] PROCESS FOR PRODUCING RIMMED ENAMELING STEEL

[75] Inventors: Larry E. Gardner, Tipp City; John J. Grenawalt, Boardman Township, County of Mahoning, both of Ohio; Adolph John Birkle, Jackson, Mich.

[73] Assignee: Youngstown Sheet and Tube Company, Youngstown, Ohio

[22] Filed: June 6, 1973

[21] Appl. No.: 367,554

Related U.S. Application Data

[63] Continuation of Ser. No. 796,148, Feb. 3, 1969, abandoned.

[52] U.S. Cl. ..... 148/2; 75/123 B; 75/123 J; 148/12.1; 148/16; 148/36

[51] Int. Cl.[2] ..... C21D 7/14

[58] Field of Search ..... 75/123 B, 123 J; 148/2, 148/3, 12.1, 16, 36

[56] References Cited

UNITED STATES PATENTS

| | | | |
|---|---|---|---|
| 2,356,450 | 8/1944 | Epstein | 75/123 |
| 3,215,566 | 11/1965 | Mayer | 148/16 |
| 3,239,390 | 3/1966 | Matsukura et al. | 148/12.1 |
| 3,248,270 | 4/1966 | Laidman | 148/12 |
| 3,320,099 | 5/1967 | Weber | 148/2 |
| 3,556,866 | 1/1971 | Gibbs et al. | 148/16 |
| 3,558,370 | 1/1971 | Boni | 148/36 |
| 3,677,834 | 7/1972 | Mayer et al. | 148/36 |

*Primary Examiner*—R. Dean
*Attorney, Agent, or Firm*—John Stelmah

[57] ABSTRACT

A cold-rolled rimmed steel composition including vanadium and nitrogen, and process for producing the same with a preferred grain structure, which steel is particularly adapted for one-coat vitreous enameling.

2 Claims, No Drawings

PROCESS FOR PRODUCING RIMMED ENAMELING STEEL

CROSS-REFERENCE TO RELATED APPLICATIONS

This is a continuation of copending application Ser. No. 796,148, Feb. 3, 1969 now abandoned.

BACKGROUND OF INVENTION

This invention relates to a new and improved steel particularly adapted for vitreous enameling applications and process for producing such steel. More specifically, this invention relates to a vanadium-nitrogen bearing rimmed steel, and process for producing the same, which steel is particularly adapted for one-coat porcelain enameling.

Steels produced for use in enameling applications may be classified in two categories: one-coat and two-coat. Two-coat enameling steels generally contain above .01% carbon, with some of the carbon being in the form of iron carbide with the base matrix. When such steels are coated with a porcelain frit and fired, surface carbides react with the frit to produce carbonaceous gas, which in turn produces pits or gas bubbles in the enameled surface. An additional coat is then applied to cover these defects and to produce a smooth finished surface. One-coat enameling steels are generally decarburized to a carbon level below 0.007%. Consequently, no free carbides exist in the base matrix. Since, under such condition, there is little or no danger of carbide reaction with the enameling frit to form defects, such materials may require only a single coat of frit to produce the desired surface. It is apparent that such one-coat steels result in considerably saving of time and money and why they have come to be in great favor among enamelers.

However, the decarburized one-coat steels that have been available, heretofore, usually suffer from severe loss of strength after the forming and firing operations. Such loss is usually produced by the thermal and mechanical treatments to which the material has been subjected during processing. During forming, cold work is introduced into the material, with strain levels ranging up to 20%. The subsequent firing of the frit coating to the base metal results in recrystallization and grain growth, and a concomitant loss of strength. Flexing or other work loading of the enameled part may then produce yielding of the base metal. The brittle enamel surface does not yield and hence spalls from the base metal. The spalled or chipped material then must be either scrapped or re-enameled. Consequently, such materials are restricted to those applications where higher-fired strengths are required.

The desideratums for direct one-coat enameling steels include: resistance to formation of gas producing defects; good pickling rate; adequate formability; suitable resistance to sag and distortion at enameling temperatures; and adequate strength after enameling. The one-coat steels which have been available heretofore to the porcelain enameling industry do not exhibit all of these desirable characteristics to a suitable degree; for example some of the titanium stabilized steels exhibit a good yield strength after firing characteristic but do not present a suitable surface appearance.

OBJECTS AND SUMMARY OF THE INVENTION

It is an object of this invention to provide an improved enameling steel, and process for producing the same, which satisfies the above referred to desideratums. It is a further object of this invention to provide an enameling steel which is adapted for one-coat enameling application and which obviates some of the disadvantages of the prior art one-coat enameling steels.

Briefly, the objects are attained by providing a new chemical composition for an enameling steel and process for producing the same, which process correlates the composition with the hot rolling, cold reduction, and annealing steps. The present invention provides for an improved one-coat enameling steel, exhibiting good surface appearance, exceptionally high yield strength after straining and heating to enamel-firing temperatures, good resistance to shape distortion (sag) during the firing cycle. A preferred embodiment of the enameling steel comprises, in percent by weight: less than 0.007 carbon (after decarburization), 0.30 to 0.50 manganese, 0.025 to 0.06 vanadium, 0.009 to 0.015 nitrogen, and with the principal portion of the remainder being iron with ordinary impurities.

The invention further provides for a process for producing an enameling steel having high yield strength after straining and firing comprising the steps of: (a) hot-rolling a ferritic composition of this invention at a temperature in the range of 1590° to 1630°F, more preferably in the range of 1600° to 1610°F, (b) cold-reducing the steel product, preferably in the order of 30 to 60%, and (c) decarburize annealing the steel product, preferably at a temperature in the order of 1340° to 1350°F.

DESCRIPTION OF PREFERRED EMBODIMENTS

The following example discloses the ranges of the principal elements of embodiment of the composition from which a one-coat enameling steel, within the scope of the present invention, is prepared:

| Element | | Percent by Weight Acceptable | Percent by Weight Preferred |
|---|---|---|---|
| Carbon (C), open hearth | | | .04–.16 |
| after decarburization | | less than .007 | less than 0.005 |
| Manganese (Mn) | | 0.2 to 0.7 | 0.3 to 0.5 |
| Vanadium (V) | | 0.02 to .08 | 0.025 to 0.06 |
| Nitrogen (N) | | 0.008 to 0.016 | 0.009 to 0.015 |
| Phosphorous (P) | permissible residuals | 0.01 max. | 0.005 |
| Sulphur (S) | | 0.05 max. | 0.02 to 0.03 |
| Silicon (Si) | | 0.04 max. | 0.01 max. |
| Aluminum (Al) | | up to 0.01 | up to 0.01 |
| Copper (Cu) | | 0.06 max. | 0.03 to 0.04 |
| Nickel (Ni) | | 0.06 max. | 0.03 to 0.04 |
| Chromium (Cr) | | 0.06 max. | 0.03 to 0.04 |

Iron constitutes the base of and comprises the balance of the composition with the exception of insignificant amounts of impurities incident to usual steel-making practice such as iron oxides, other metallic oxides, and the like.

The composition includes vanadium within the specified range and also purposefully includes nitrogen. It has been known in the art to provide rimmed steels containing vanadium and residual nitrogen levels for use as deep-drawing steels which are non-aging. In such rimmed steels, the vanadium is added to combine with the nitrogen, which nitrogen causes aging in rimmed steels. The present invention may be distinguished from such compositions in that nitrogen is purposely added as an alloying element so as to combine with the vanadium in a manner whereby the yield strength after firing is maintained at a higher level than heretofore attained.

Semi-killed steels, which include vanadium and nitrogen, have been produced. However, these semi-killed steels are not subjected to cold reductiton and decarburization annealing and are normally used in the hot-rolled condition. Vanadium and nitrogen additives are employed in semi-killed steels to facilitate the standard precipitation hardening effects and grain refinement of the hot-rolled product.

The use of vanadium and nitrogen additives in an enameling steel is considered unique. We have discovered that such addition retards recrystallization and grain growth during the processing of the composition. These additives, when present in the appropriate indicated amounts and accompanied by the described processing techniques, produce a material which retains its strength through all strain levels and firing cycles normally encountered in enameling procedures. The art has not previously recognized that vanadium and purposeful nitrogen additions can retard the recrystallization kinetics of the parent steel composition and retain the original grain size and strength levels.

A unique process has been discovered for treating the steels described herein to retard recrystallization and grain growth during the processing and provide a material which retains its strength through the strain levels and firing cycles normally encountered in enameling procedures. The steels of this invention are processed through most of the sequence of steps usually followed in processing enameling steels; however, there are several important distinctions in the processing parameters as will hereinafter be described.

The usual sequence of steps include: hot-rolling conditioned slabs to form a band, which optionally may be of a nominal 0.093 inch thickness; coiling of the band at a temperature in the range of 1050° to 1100°F; pickling; cold-reduction, which optionally may be to a nominal 0.035 inch thickness; decarburize annealing the cold-reduced band; and temper rolling.

The following Table I compares the processing parameters, and resultant physical characteristics, of three different steel coils having the composition of this invention.

TABLE I

| Coil No. | Hot Roll Temp. °F | Coiling Temp. °F | Annealing Cycle | Sag/ins. | ASTM* Grain Size No. | YSAF** psi at 20% Prestrain |
|---|---|---|---|---|---|---|
| 1 | 1660 | 1050 | S'td. | .98 | 10.5 | 17,000 |
| 2 | 1580 | 1060 | S'td. | 1.02 | 10 | 50,000 |
| 3 | 1610 | 1025 | Spec. | .46 | 9 | 50,000 |

*ASTM = American Society for Testing Materials
**YSAF = Yield Strength After Firing The standard (S'td.) annealing cycle comprises: heating from room temperature to 1320°F; followed by a 10-hour wet cycle (circulating a moistened decarburizing gas); a 3-hour dry cycle (circulating a dry decarburizing gas); and cooling within the furnace to 200°F.

The special (Spec.) annealing cycle comprises: heating from room temperature to 1340° to 1350°F; followed by a 3-hour holding cycle in the range of 1340° to 1350°F; a 10-hour wet cycle at 1340° to 1350°F; a 3-hour dry cycle at 1340° to 1350°F, and slow cooling to 200°F, preferably within the annealing furnace.

In each of the cases above described, the "open coil" annealing technique was used. However, it will be understood that a continuous annealing technique may also be employed. It is only important that the entire surface of the steel be exposed to the annealing atmosphere during processing.

In respect to Coil No. 1, it will be noted that the yield strength after firing (YSAF) is low and that the sag is considerably out of a preferred maximum of 0.5 in. range. It is believed that these undesirable characteristics may be attributed to the high finishing temperature associated with the hot-rolling procedure. The poor sag characteristics are believed to be attributable to the fine grain size produced by standard cold reductions and annealing cycles.

In respect to Coil No. 2, while the YSAF is satisfactory, the sag is undesirably high. It is believed that the improvement in YSAF may be attributed to the lower hot-roll finishing temperature.

In contrast, Coil No. 3, which was processed in accordance with the techniques of this invention, not only provides a high YSAF but also a better than 50% reduction in sag.

The hot-roll finishing temperatures indicated in the table are those which are appropriate when the strip or band temperature is measured just prior to entry between the rolls of the last finishing stand. It will be understood that these temperatures vary somewhat according to the location of the temperature measurement and the type and accuracy of the measuring device. It is believed that a temperature range of 1590° to 1630°F will yield satisfactory results; however, a rolling temperature range of 1600° to 1610°F is preferred.

In order to measure the sag the standard ASTM test was employed. The test comprises heating a two-inch by twelve-inch steel specimen for ten minutes at 1500°F and measuring the amount of deflection which results. The specimen is supported on ten inch centers and sag is considered to be the difference in deflection, before and after firing, as measured at the center of the strip.

Further typical results are shown in the following Table II for a number of ingots produced from the steel composition of and processed in accordance with this invention. The formability, enamelability and tensile properties of this material are good as compared to other enameling steels.

TABLE II

| | |
|---|---|
| As Received Properties | |
| Yield Strength | 35,000 psi |
| Ultimate Tensile Strength | 51,000 psi |
| Elongation (in 2" gage) | 37% |
| ASTM Grain Size | 8 – 8¾ |
| YSAF | |
| % Prestrain | ksi |
| 0 | 38 |
| 4 | 40 |
| 8 | 44 |
| 12 | 46 |
| 16 | 49 |
| 20 | 30 – 45 |
| Enamelability | |
| Enamel Adherence | Good – Excellent |
| Surface Appearance | Good |
| Pickling Rate (prior to enameling) | 2 – 3 gms/sq. ft. for 30 mins. in 7% $H_2SO_4$ at 155°F |

It is common for enamlers to specify in their purchase requirements for enameling steel that the steel shall have a minimum YSAF of 20,000 psi. As indicated above in Table II, the enameling steel of this invention more than admirably fulfills this requirement. As a matter of fact, so far as we are aware, others have not been able to consistently produce an enameling steel which has a YSAF of 40,000 psi after a minimum prestrain of at least 12%.

It is believed that a synergistic effect of the vanadium and nitrogen constituents enabled the steel to retain its strength, after being formed and subsequently furnace fired at 1450°F for 7 minutes. The forming operation was simulated by prestraining sheet tensile specimens in accordance with the indicated percentages, and then heating the strained sheets to 1450°F for 7 minutes furnace time.

It was also determined that the maintenance of the grain size within the preferred range of 8 to 9½ ASTM grain size (and more preferably 8 to 8¾) contributes to the good sag resistant characteristics of the steel. Generally, it is expected that the combined vanadium and nitrogen additions prevent softening during the firing operation and that the grain boundaries lose strength as the temperature increases. Simultaneous retention of strength by the grains and softening of the grain boundaries cause the grains to slide past one another and produce large distortions during firing. However, it was found unexpectedly that this grain-boundary sliding can greatly be reduced or eliminated by developing and maintaining the indicated preferred grain size with compositions of the type of this invention. One of the methods of controlling and maintaining the grain size is the use of the special annealing cycle described above. A second method of maintaining and controlling the grain size is to use a lower than usual percent cold reduction. The development of the preferred grain structure and size is believed to contribute towards the sag resistance characteristic. This grain structure and size is achieved throughout the thickness of the steel sheet processed in accordanace with this invention. Consequently, its grain size structure may be described as homogeneous throughout the thickness, as opposed to and distinguishable from those laminar-type grain structures wherein a surface of one grain size is produced over an inner core of another grain size.

While we have described a presently preferred embodiment of the enameling steel of this invention and have illustrated a presently preferred method of producing the same, it is to be understood that the invention is not limited thereto but may be otherwise variously embodied and practiced within the scope of the following claims.

We claim:

1. A process for producing a rimmed unkilled enameling steel characterized by a minimum yield strength after firing of 40 ksi, which process comprises:

a. providing a rimmed unkilled steel consisting essentially, in percent by weight, of: 0.02 to 0.08 vanadium; 0.008 to 0.016 nitrogen; 0.2 to 0.7 manganese; 0.04 to 0.16 carbon; and the balance being essentially iron;

b. hot rolling said steel at a temperature in the range of 1590° to 1630°F;

c. cold reducing the hot rolled steel; and d. subjecting the cold reduced steel to a decarburizing annealing cycle which will produce a substantially homogeneous grain structure throughout its thickness and reduce the carbon content to less than .01 percent, which annealing cycle comprises:

1. heating said steel to a temperature in the range of 1340° to 1350°F and holding at that temperature for about three hours;
2. heating said steel in a wet atmosphere of decarburizing gas in the range of 1340° to 1350°F;
3. heating said steel in a dry atmosphere of decarburizing gas at a temperature in the range of 1340° to 1350°F; and
4. furnace cooling said steel to a temperature of about 200°F.

2. A process for producing a rimmed unkilled enameling steel having good sag resistance and high yield strength firing characteristics, which process comprises the following steps:

a. providing a rimmed unkilled steel consisting essentially of the following constituents in percent, by weight: from about 0.2 to 0.7 manganese, from about 0.02 to 0.08 vanadium, from about 0.008 to about 0.016 nitrogen, up to 0.01 aluminum, and 0.04 to 0.16 carbon, the remainder being iron with ordinary impurities;

b. hot rolling said steel at a temperature in the general range of 1590° to 1630°F;

c. cold reducing said steel in the order of 30 to 60 percent of its thickness; and d. subjecting said steel to a decarburizing annealing cycle, producing substantially homogeneous grain structure throughout its thickness having an ASTM grain size in the range of 8 to 9½ and reducing the carbon content to less than 0.01 percent, which cycle comprises:

1. heating said steel to a temperature in the range of 1340° to 1350°F and holding at that temperature for about 3 hours;
2. heating said steel in a wet atmosphere of decarburizing gas at a temperature in the range of 1340° to 1350°F for about 10 hours;
3. heating said steel in a dry atmosphere of decarburizing gas at a temperature in the range of 1340° to 1350°F for about 3 hours; and
4. furnace cooling said steel to a temperature of about 200°F.

* * * * *